US008215794B2

(12) United States Patent
Xue et al.

(10) Patent No.: US 8,215,794 B2
(45) Date of Patent: Jul. 10, 2012

(54) LARGE-ANGLE LED LIGHTING APPARATUS

(75) Inventors: Xinshen Xue, Shenzhen (CN); Pida Lin, Shenzhen (CN)

(73) Assignee: Civilight Shenzhen Semiconductor Lighting Co., Ltd., Shenzhen (CN)

( * ) Notice: Subject to any disclaimer, the term of this patent is extended or adjusted under 35 U.S.C. 154(b) by 18 days.

(21) Appl. No.: 12/835,971

(22) Filed: Jul. 14, 2010

(65) Prior Publication Data

US 2011/0141726 A1 Jun. 16, 2011

(30) Foreign Application Priority Data

Dec. 11, 2009 (CN) ..... 2009 1 0188788

(51) Int. Cl.
*F21V 29/00* (2006.01)

(52) U.S. Cl. ..... 362/231; 362/294; 362/249.02; 362/249.11; 362/800

(58) Field of Classification Search ..... 362/235, 362/231, 800, 249.02, 249.11, 294, 373
See application file for complete search history.

(56) References Cited

U.S. PATENT DOCUMENTS

| | | | | |
|---|---|---|---|---|
| 5,101,326 | A * | 3/1992 | Roney | 362/545 |
| 7,530,707 | B2 * | 5/2009 | Plank et al. | 362/230 |
| 7,677,765 | B2 * | 3/2010 | Tajul et al. | 362/294 |
| 7,864,204 | B2 * | 1/2011 | Overes | 345/102 |
| 7,922,363 | B2 * | 4/2011 | Yang et al. | 362/294 |
| 7,985,004 | B1 * | 7/2011 | Schach et al. | 362/276 |
| 2001/0002119 | A1 * | 5/2001 | Winterer et al. | 338/42 |

* cited by examiner

*Primary Examiner* — Anabel Ton
(74) *Attorney, Agent, or Firm* — Hamre, Schumann, Mueller & Larson, P.C.

(57) ABSTRACT

A large-angle LED lighting apparatus includes a lamp shield having an outer cover and a diffusing cover; a printed circuit board; a plurality of LED lamps electrically coupled to the printed circuit board; and a heat dissipating post. Wherein, the LED lamps are annularly arranged around a center of the printed circuit board, the LED lamps are electrically coupled to an upper surface or a lower surface or the upper and lower surfaces of the printed circuit board, the LED lamps are arranged to form an angle at a range from 20 degrees to 170 degrees relative to the printed circuit board, and the heat dissipating post is fixedly or detachably connected with the printed circuit board.

11 Claims, 6 Drawing Sheets

LARGE-ANGLE LED LIGHTING APPARATUS

TECHNICAL FIELD

The present invention relates to a lighting apparatus, and more particularly, to a large-angle LED lighting apparatus.

BACKGROUND

Currently, a conventional LED (Light Emitting Diode) light lamp is limited within a small range of applications due to the light emitting angle, dissipating heat effect and manufacturing process of an LED. A rear portion of the LED lamp do not have light or weak light because of a small-angle LED light lamp which the angle is in the range from 130 degrees to 170 degrees. A conventional high power LED light lamp has the following technical problems: (1) A light-emitting angle of the light source is limited by a light-emitting angle of an LED 1; (2) Luminous flux of an LED light lamp is low; (3) The light points of lighting apparatus formed by a plurality of LEDs may be seen, and it is difficult to handle the light points; (4) Color rendering index of an LED light lamp is low. The conventional LED light lamps can not completely replace the incandescent lamps because the light emitting angle of the LED light lamp in the market is no more than 170 degrees.

There is, therefore, a need for a large-angle LED lighting apparatus, which causes that a light source has a large light-emitting angle, and uniform radiation.

SUMMARY

In order to solve the problems of small irradiation angle and complex structure in the conventional LED lighting apparatus, the technical scheme of the present invention includes as follows:

A large-angle LED lighting apparatus includes a lamp shield having an outer cover and a diffusing cover; a printed circuit board; a plurality of LED lamps electrically coupled to the printed circuit board; and a heat dissipating post. Wherein, the LED lamps are annularly arranged around a center of the printed circuit board, the LED lamps are electrically coupled to an upper surface or a lower surface or the upper and lower surfaces of the printed circuit board, the LED lamps are arranged to form an angle at a range from 20 degrees to 170 degrees relative to the printed circuit board, and the heat dissipating post is fixedly or detachably connected with the printed circuit board.

Preferably, the LED lamps are arranged to form a 30 degrees or 45 degrees or 60 degrees or 90 degrees angle relative to the printed circuit board.

Preferably, the maximum irradiation angle of the large-angle LED lighting apparatus reaches 290 degrees.

Preferably, the LED lamps are single-color LED lamps or LED lamps formed by the white light mixed with 400-750 NM LED band light.

Preferably, a silicon gel is filled with a space covered by the diffusing cover.

Preferably, a high thermal conductivity material which is paste material or soft sheet material, is disposed between the printed circuit board and the heat dissipating post.

Preferably, the outer cover and diffusing cover is made of glass or plastic.

Preferably, the heat dissipating post is made of copper, aluminum, or ceramic material.

Other objects, advantages and novel features of the present invention will become more apparent from the following detailed description when taken in conjunction with the accompanying drawings, in which:

REFERENCE NUMERALS

1—lamp shield, 101—outer cover, 102—diffusing cover; 2—PCB; 3—LED lamp; 4—heat dissipating post, 401—thread hole; 5—screw; 501—fixed hole; 6—silicon gel.

DETAILED DESCRIPTION OF THE PREFERRED EMBODIMENTS

Objects, advantages and embodiments of the present invention will be explained below in detail with reference to the accompanying drawings. However, it is to be appreciated that the following description of the embodiment(s) is merely exemplary in nature and is no way intended to limit the invention, its application, or uses.

Figure 1:
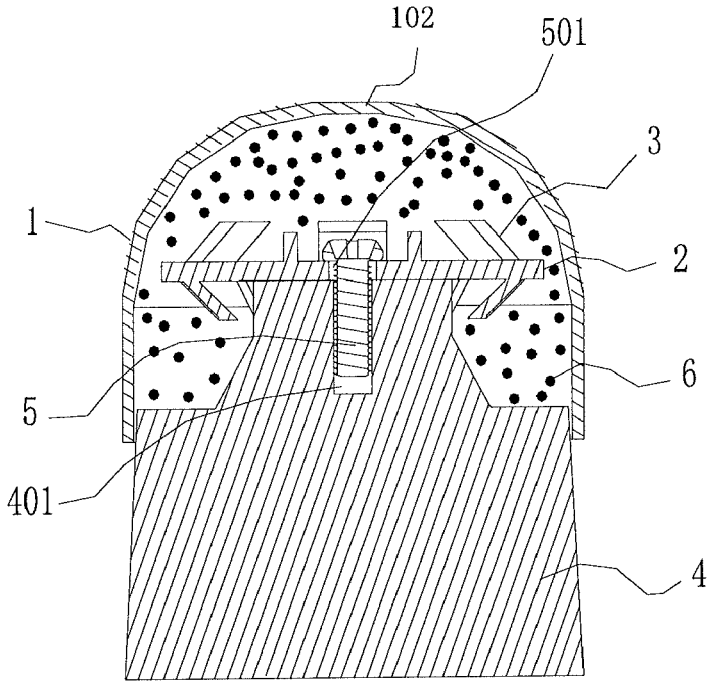
FIG. 1 is a sectional view of a large-angle LED lighting apparatus in the accordance with a first embodiment in the present invention, which is disposed on a single side of a PCB.
Figure 2:
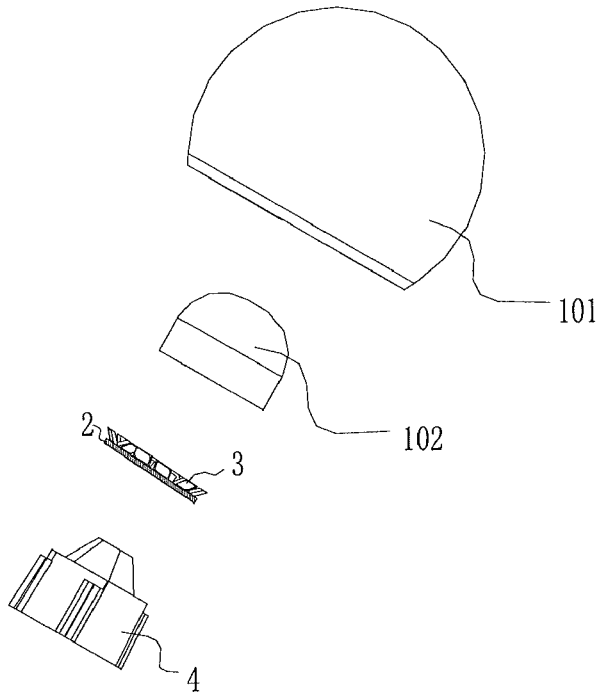
FIG. 2 is an exploded view of the large-angle LED lighting apparatus, which is disposed on the single side of the PCB.
Figure 3:
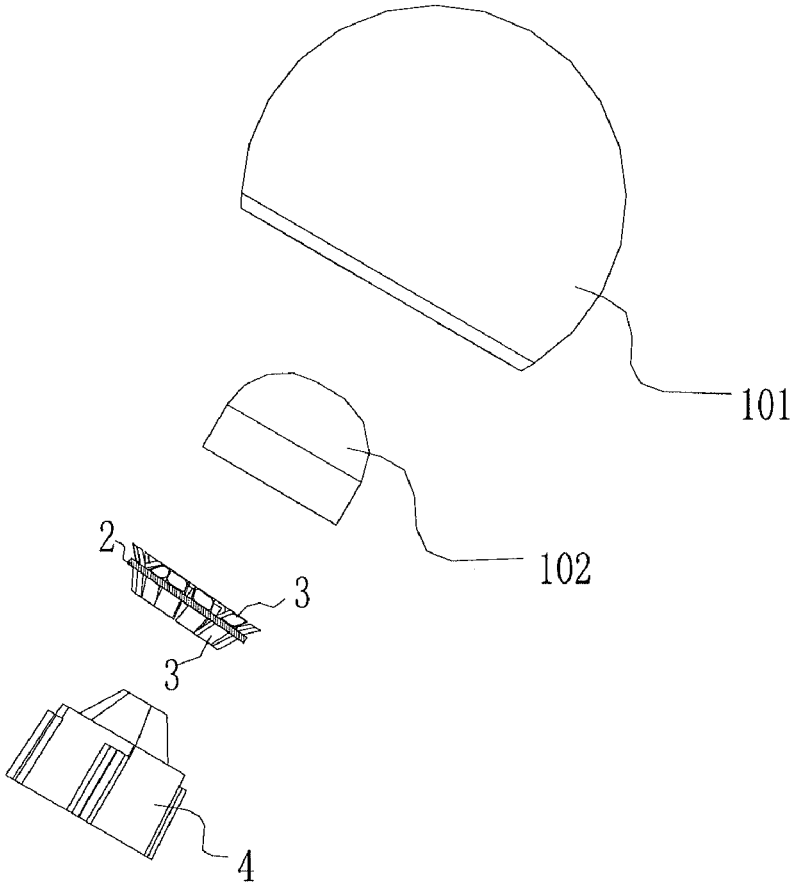
FIG. 3 is an exploded view of the large-angle LED lighting apparatus, which is disposed on double sides of the PCB.
Figure 4:
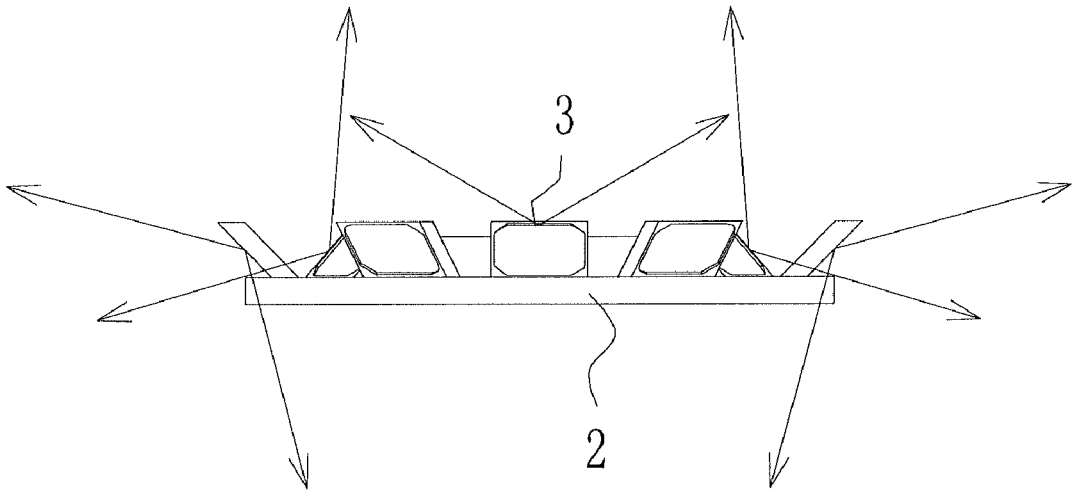
FIG. 4 is a light distribution view of the large-angle LED lighting apparatus, which is disposed on the single side of the PCB.
Figure 5:
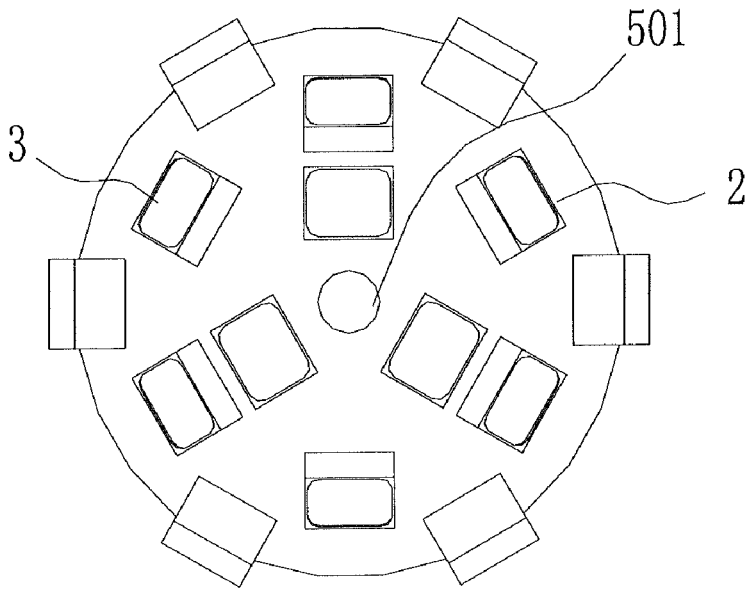
FIG. 5 is a front view of the large-angle LED lighting apparatus, which is disposed on the single side of the PCB.
Figure 6:
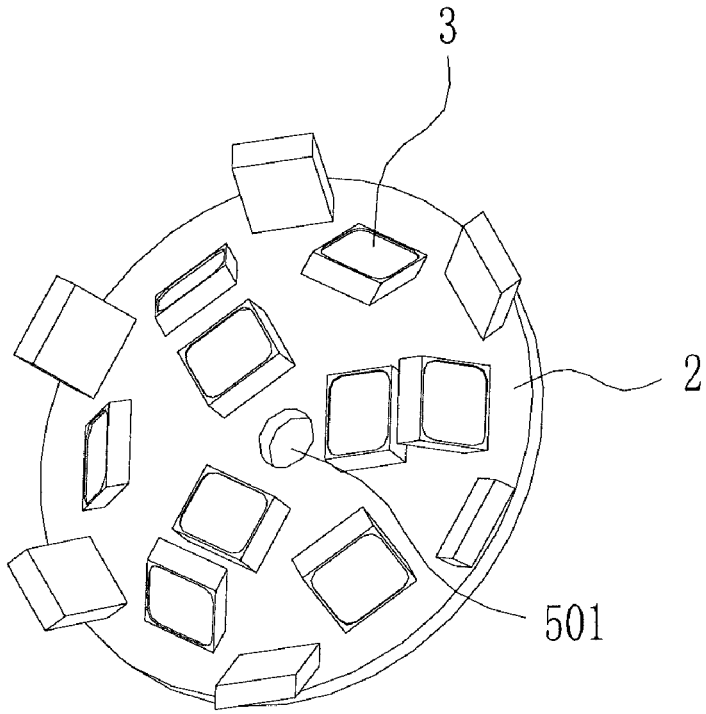
FIG. 6 is a perspective view of the large-angle LED lighting apparatus, which is disposed on the single side of the PCB.
Figure 7:
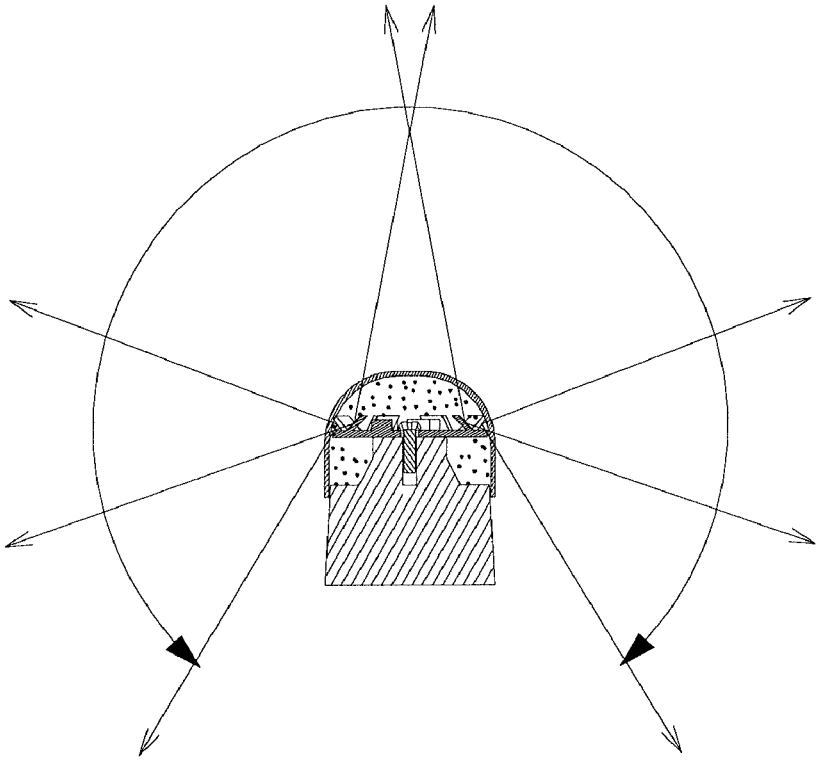
FIG. 7 is a state reference view of the large-angle LED lighting apparatus, which is in use and disposed on the single side of the PCB.
Figure 8:
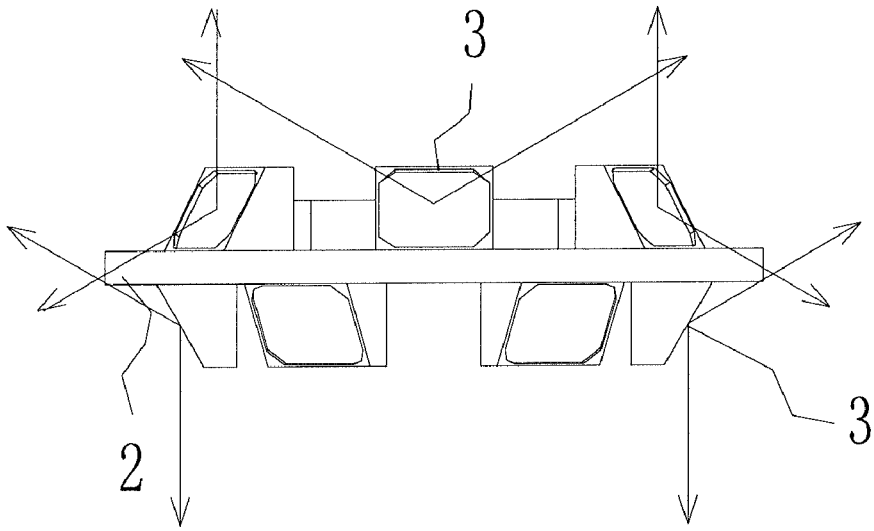
FIG. 8 is a light distribution view of a large-angle LED lighting apparatus in the accordance with a second embodiment in the present invention, which is disposed on double sides of the PCB.
Figure 9:
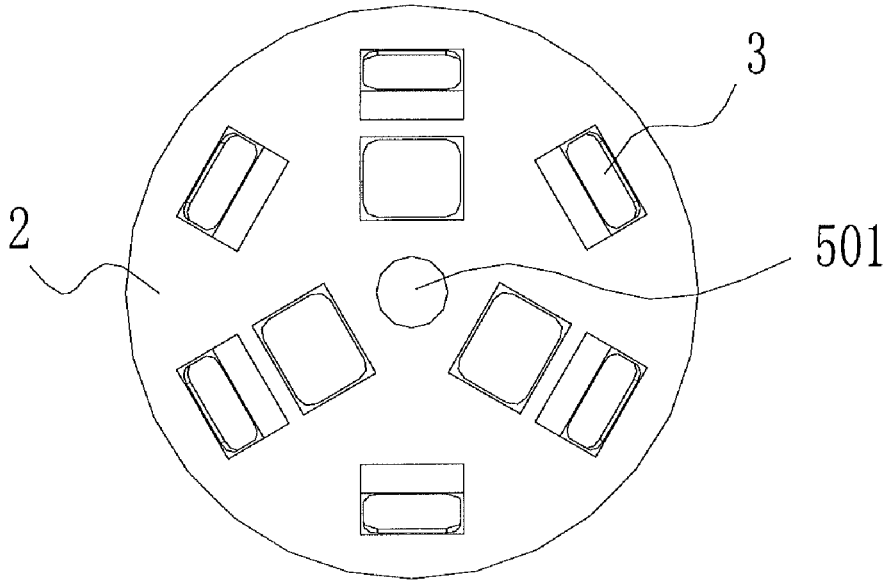
FIG. 9 is a top view of the large-angle LED lighting apparatus in the accordance with the second embodiment in the present invention, which is disposed on double sides of the PCB.
Figure 10:
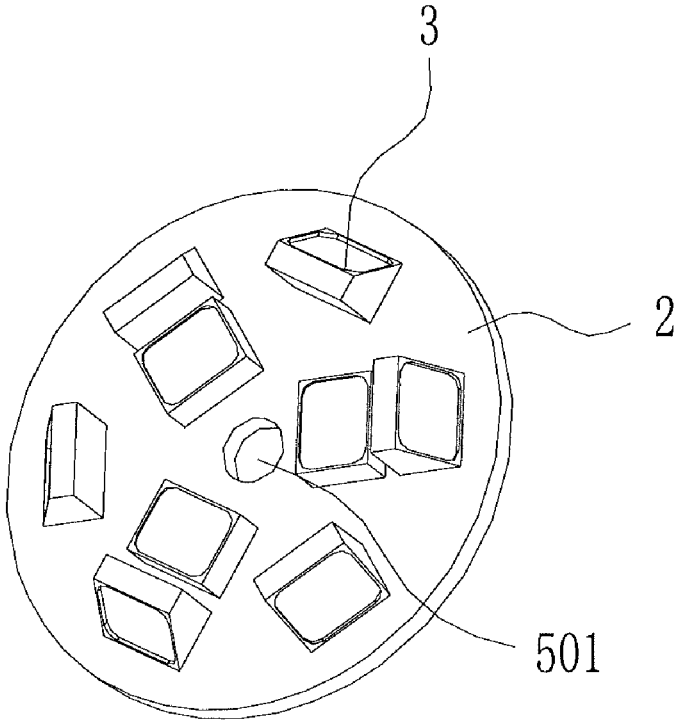
FIG. 10 is a perspective view of the large-angle LED lighting apparatus in the accordance with the second embodiment in the present invention, which is disposed on double sides of the PCB.
Figure 11:
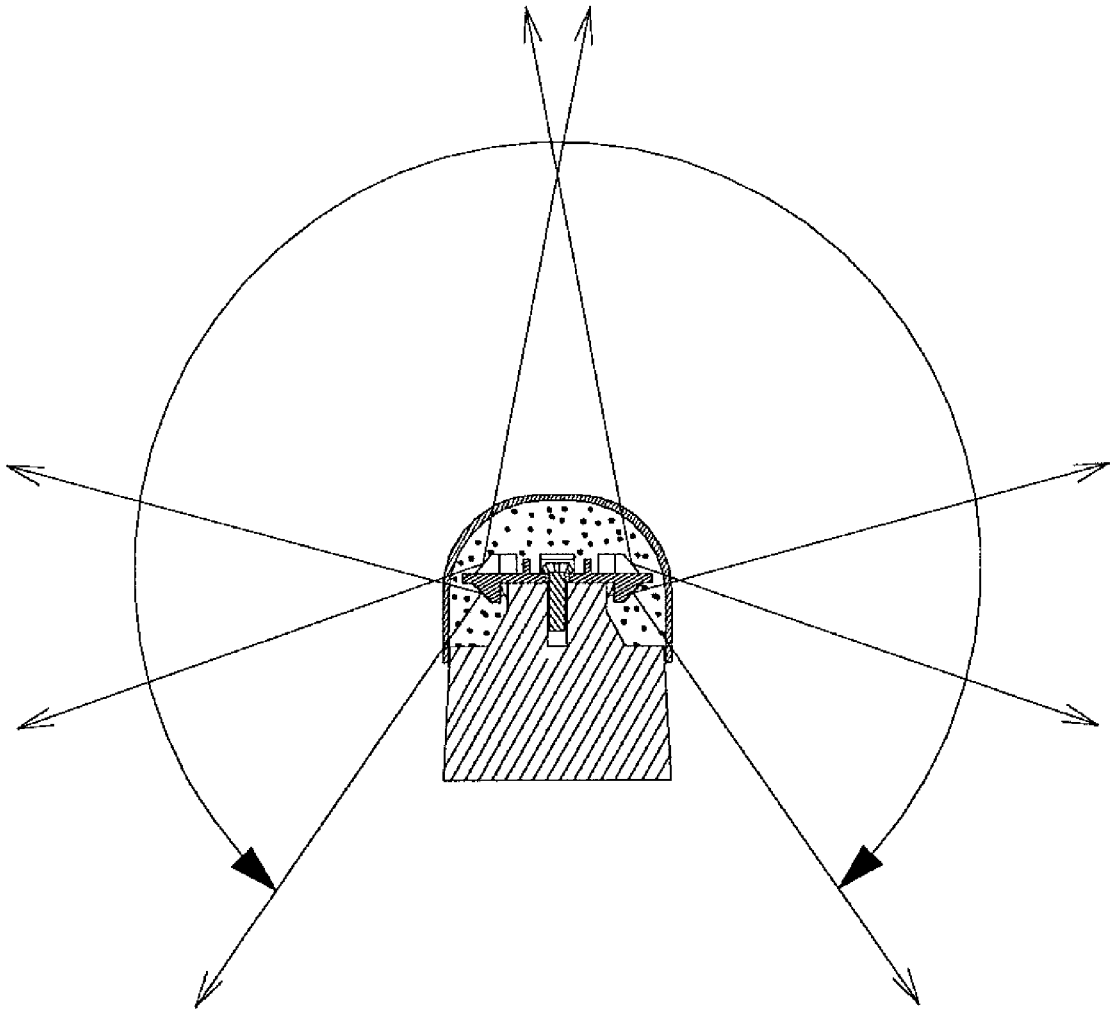
FIG. 11 is a state reference view of the large-angle LED lighting apparatus, which is in use and disposed on double sides of the PCB.

Referring to FIGS. 1-11, a large-angle LED lighting apparatus in the accordance with a first embodiment in the present invention include a lamp shield 1, a printed circuit board (PCB) 2, a plurality of LED lamps 3 and a heat dissipating post 4. The lamp shield 1 includes an outer cover 101 and a diffusing cover 102 which is used to accommodate and position silicon gel 6. The LED lamps 3 are welded to the printed circuit board 2. The LED lamps 3 are annularly arranged around a center of the printed circuit board 2. The LED lamps 3 may be electrically coupled to an upper surface or lower surface of the printed circuit board 2. There is 30~90 degrees angle between the LED lamps 3 and the printed circuit board 2. Preferably, the angle may be 30 degrees, 45 degrees, 60 degrees, or 90 degrees. The emission angle of the LED light sources are increased through setting different angles between the LED lamps 3 and the printed circuit board 2 or through arranging the LED lamps 3 to the different locations so that LED lamps 3 emit uniform rays and the rays are naturally intersected and mixed so as to form a three-dimensional light source with a maximum radiation angle. The heat dissipating post 4 is made of copper, aluminum, ceramic materials and other materials with high thermal conductivity, and functions as dissipating heat and transferring heat to increase the thermal conductivity effect. The heat dissipating post 4 defines a thread hole 401 therein. The printed circuit board 2 defines a fixed hole 501. A screw 5 passes through the fixed hole 501 to engage with the thread hole 401, to thereby securely fix the printed circuit board 2 to the heat dissipating post 4. Thus, it is convenient to detach/attach the printed circuit board 2 from/to the heat dissipating post 4 to solve more complex problems in the existing production process due to overfull parts. The heat dissipating post 4 may act as a lamp post to reduce the thermal resistance so that heat may be transferred to a surface of the heat dissipating post 4. In order to enhance heat dissipation, a high thermal conductivity material is disposed between the printed circuit board 2 and the heat dissipating post 4. The high thermal conductivity material may be paste material or soft sheet material, and filled in a gap formed between the printed circuit board 2 and the heat dissipating post 4. The heat emitted from the LED lamp may be dissipated via the printed circuit board 2, the high thermal conductivity material and the heat dissipating post 4 in order to solve the problem of dissipating heat. The printed circuit board 2 is placed in the diffusing cover 102. The silicon gel 6 which is added dispersants may be filled with a space covered by the diffusing cover 102, and the silicon gel 6 is resistant to elevated temperatures and functions as locating a position and diffusing light. A quantity of the added silicon gel 6 is determined according to light effects. Simultaneously, light points in the large-angle LED lighting apparatus are blurry to thereby solve the problem of light points. The LED (light-emitting diodes) lamps are soldered on the PCB, and the LED lamps may be all kinds of single-color LED lamps, or LED lamps formed by the white light mixed with 400-750 NM LED band light. Thus the color-rendering index is improved, and the color temperature is changed, and so on. The present invention provides an LED lighting apparatus which its irradiation angle can reach a range from minimum 240 degrees to maximum 290 degrees, and can replace incandescent lamps completely.

The present invention may be embodied in other forms without departing from the spirit or novel characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

What is claimed is:

1. A large-angle LED lighting apparatus comprising:

a lamp shield having an outer cover and a diffusing cover;

a printed circuit board;

a plurality of LED lamps electrically coupled to the printed circuit board; and a heat dissipating post, wherein the LED lamps are annularly arranged around a center of the printed circuit board, the LED lamps are electrically coupled to an upper surface or a lower surface or the upper and lower surfaces of the printed circuit board, the LED lamps are arranged to form an angle at a range from 20 to 170 degrees relative to the printed circuit board, and the heat dissipating post is fixedly or detachably connected with the printed circuit board, wherein the maximum irradiation angle of the large-angle LED lighting apparatus reaches 290 degrees.

2. The large-angle LED lighting apparatus as claimed in claim 1, wherein the LED lamps are arranged to form a 30 degrees or 45 degrees or 60 degrees or 90 degrees angle relative to the printed circuit board.

3. The large-angle LED lighting apparatus as claimed in claim 1, wherein the LED lamps are single-color LED lamps or LED lamps formed by white light mixed with 400-750 NM LED band light.

4. The large-angle LED lighting apparatus as claimed in claim 1, wherein a silicon gel is filled with a space covered by the diffusing cover.

5. The large-angle LED lighting apparatus as claimed in claim 1, wherein a high thermal conductivity material which is paste material or soft sheet material, is disposed between the printed circuit board and the heat dissipating post.

6. The large-angle LED lighting apparatus as claimed in claim 1, wherein the outer cover and the diffusing cover are made of glass or plastic.

7. The large-angle LED lighting apparatus as claimed in claim 1, wherein the heat dissipating post is made of copper, aluminum, or ceramic material.

8. A large-angle LED lighting apparatus comprising:

a diffusing cover;

a printed circuit board;

a plurality of LED lamps electrically coupled to the printed circuit board, wherein the plurality of LED lamps and the printed circuit board are covered by the diffusing cover; and a heat dissipating post, wherein the LED lamps are annularly arranged around a center of the printed circuit board, the LED lamps are electrically coupled to a surface of the printed circuit board, the LED lamps are arranged to form an angle at a range from 20 degrees to 170 degrees relative to the printed circuit board, and the heat dissipating post is connected with the printed circuit board for dissipating heat, wherein a silicon gel is filled with a space covered by the diffusing cover.

9. The large-angle LED lighting apparatus as claimed in claim 8, wherein the LED lamps are arranged to form a 30 degrees or 45 degrees or 60 degrees or 90 degrees angle relative to the printed circuit board.

10. The large-angle LED lighting apparatus as claimed in claim 8, wherein the maximum irradiation angle of the large-angle LED lighting apparatus reaches 290 degrees.

11. The large-angle LED lighting apparatus as claimed in claim 8, wherein a high thermal conductivity material is disposed between the printed circuit board and the heat dissipating post.

* * * * *